US009225051B2

(12) United States Patent
Guyette

(10) Patent No.: US 9,225,051 B2
(45) Date of Patent: Dec. 29, 2015

(54) TUNING BANDWIDTH AND CENTER FREQUENCIES IN A BANDPASS FILTER

(75) Inventor: Andrew C. Guyette, Alexandria, VA (US)

(73) Assignee: The Goverment of the United States of America, as represented by the Secretary of the Navy, Washington, DC (US)

( * ) Notice: Subject to any disclaimer, the term of this patent is extended or adjusted under 35 U.S.C. 154(b) by 396 days.

(21) Appl. No.: 13/247,793

(22) Filed: Sep. 28, 2011

(65) Prior Publication Data

US 2012/0075039 A1 Mar. 29, 2012

Related U.S. Application Data

(60) Provisional application No. 61/387,344, filed on Sep. 28, 2010.

(51) Int. Cl.
*H01P 1/203* (2006.01)
*H01P 7/08* (2006.01)

(52) U.S. Cl.
CPC ..... *H01P 1/20381* (2013.01); *H01P 1/20336* (2013.01); *H01P 7/088* (2013.01)

(58) Field of Classification Search
CPC ..... H01P 1/20345; H01P 1/20327; H01P 1/20336; H01P 7/088
USPC ..... 333/203, 205, 235
See application file for complete search history.

(56) References Cited

U.S. PATENT DOCUMENTS

| | | | | |
|---|---|---|---|---|
| 4,467,296 | A * | 8/1984 | Cohen et al. | 333/202 |
| 5,107,233 | A * | 4/1992 | Stoft | 333/168 |
| 2002/0093400 | A1 * | 7/2002 | Zhu et al. | 333/205 |
| 2006/0017525 | A1 * | 1/2006 | Goyette | 333/205 |
| 2010/0295634 | A1 * | 11/2010 | Akale | 333/205 |
| 2011/0279176 | A1 * | 11/2011 | Oran | 327/553 |

OTHER PUBLICATIONS

Fouladi et al, "An Integrated Tunable Band-Pass Filter Using MEMS Parallel-Plate Variable Capacitors Implemented with 0.35 um CMOS Technology", 2007, IEEE, pp. 505-508.*

M. Sanchez-Renedo, R. Gomez-Garcia, J. I. Alonso, and C. Briso-Rodriguez, "Tunable combline filter with continuous control of center frequency and bandwidth", *IEEE Trans. Microwave Theory Tech.*, vol. 53, pp. 191-199, Jan. 2005.

(Continued)

*Primary Examiner* — Robert Pascal
*Assistant Examiner* — Gerald Stevens
(74) *Attorney, Agent, or Firm* — US Naval Research Laboratory; Kerry L. Broome

(57) ABSTRACT

A method for independently tuning bandwidth and center frequencies in a bandpass filter. The filter can be configured with a plurality of resonators, wherein the resonators are coupled over a certain coupling region. Additionally, the filter can be configured with a plurality of tuning elements. For each of the inter-resonator couplings, at least one of the resonators associated with the inter-resonator coupling can have a first tuning element placed at a first location on the resonator and a second tuning element placed at a second location on the resonator. Simultaneously tuning the first and second tuning elements can adjust the center frequency, and offset tuning the first and second tuning elements can adjust the bandwidth frequency.

8 Claims, 8 Drawing Sheets

(56) References Cited

OTHER PUBLICATIONS

A. I. Abunjaileh and I. C. Hunter, "Combline filter with tunable bandwidth and centre frequency," 2010 IEEE MTT-S International, Anaheim, CA, pp. 1476-1479.

M. S. Ruiperez, D. Amor, J. Gonzalez, and J. I. Alonso, "Fast electronically tunable filter bank," 2005 European Microwave Conference, Oct. 4-6, 2005.

I. C. Hunter and J. D. Rhodes, "Electronically tunable microwave bandpass filters," *IEEE Trans. Microwave Theory Tech*., vol. MTT-30, pp. 1354-1360, Sep. 1982.

A. C. Guyette, Alternative architectures for narrowband varactor-tuned bandpass filters, 2009 European Microwave Conference, Rome, 2009.

V. V. Tyurnev, "The coupling coefficients of an assymetric pair of microwave resonators," *Journal of Communications Technology and Electronics*, vol. 35, No. 1, pp. 1-8, 2002.

B. W. Kim and S. W. Yun, "Varactor-tuned combline bandpass filter using step-impedance microstrip lines," *IEEE Trans. Microwave Theory Tech*., vol. 52, pp. 1279-1283, Apr. 2004.

* cited by examiner

TUNING BANDWIDTH AND CENTER FREQUENCIES IN A BANDPASS FILTER

CROSS-REFERENCE TO RELATED APPLICATION

This application claims priority to U.S. Provisional Patent Application entitled, "Method of Controlling the Coupling Between Electromagnetic Resonators," filed on Sep. 28, 2010, and assigned U.S. Application No. 61/387,344; the entire contents of which are hereby incorporated by reference.

FIELD OF THE INVENTION

The invention relates to filters. More specifically, the invention relates to independently tuning bandwidth and center frequencies in a bandpass filter.

BACKGROUND

In a typical example system application, tunable filters are implemented into a receiver front-end. An antenna receives a signal and a tunable filter selects specific signals to send to a low noise amplifier, which provides the signal to a receiver. The transmission loss at the tunable filter must be minimized to avoid degrading receiver noise figure.

Microwave bandpass filters are typically realized with networks of coupled electromagnetic resonators. The strength and location of these couplings can determine a filter's bandwidth and selectivity. Center frequency tunability can be readily achieved by attaching variable reactances, typically in the form of variable capacitances, or varactors, to each resonator. As the varactors are tuned the resonant frequencies of the corresponding resonators are shifted, and so the center frequency of the entire filter response is tuned. As the center frequency is tuned the strength of the couplings change in a way determined by the geometry of the resonators. Therefore, there is a one-to-one relationship between the coupling strength and tuned center frequency, and so independent tuning of bandwidth with respect to center frequency is not possible with conventional tunable filter architectures.

The architecture typically used for varactor-tuned bandpass filters is the combline, as it is compact, provides excellent stopband performance, and can be designed to have either a constant relative bandwidth or constant absolute bandwidth response. The combline, however, is limited by the fact that a constant absolute bandwidth is difficult to achieve when non-TEM resonators (e.g. microstrip) are used, and it is not possible to independently tune the center frequency and bandwidth.

In the prior art, independent bandwidth tuning has been implemented by placing intermediate tuning elements between each resonator, but this approach tends to degrade stopband performance significantly as well as increase the size of the filter. The intermediate tuning elements are designed to be resonant at frequencies above or below the pass band of the filter, which in turn has the deleterious effect of creating a spurious secondary passband.

In another approach in the prior art, a dual-band combline structure achieved independent bandwidth tunability by trading off the bandwidth of one passband for the bandwidth of the other. However, this method is disadvantageous as twice the number of resonators are required for a given filter order and additional filtering is required to remove the second passband.

In general, there exists a direct relationship between tuning range and passband insertion loss in a tunable bandpass filter. In an attempt to overcome this relationship, switched tunable filter banks are often used. However, the switches themselves add significant insertion loss, which can largely counteract the desired performance improvement. Furthermore, switches can also increase size, weight, complexity, and power consumption.

Accordingly, there remains a need for a unique design approach that allows for the realization of tunable filters with independently tunable center frequency and bandwidth that does not require the implementation of additional hardware. Furthermore, if the bandwidth is tunable down to zero, then the filter can effectively be shut off, eliminating the need for switches in applications such as switched filter banks.

SUMMARY OF THE INVENTION

In an exemplary embodiment of the invention, a method for independently tuning bandwidth and center frequencies in a bandpass filter can be provided. A filter can be configured with a plurality of resonators that are coupled over a certain coupling region. Additionally, the filter can be configured with a plurality of tuning elements, wherein for each of the inter-resonator couplings, at least one of the resonators associated with the inter-resonator coupling has a first tuning element placed at a first location on the resonator and a second tuning element placed at a second location on the resonator. Simultaneously tuning the first and second tuning elements can adjust the center frequency, and offset tuning the first and second tuning elements can adjust the bandwidth frequency.

In another exemplary embodiment of the invention, a bandpass filter can be described. The bandpass filter can include a plurality of resonators coupled over a coupling region. Additionally, it can include a plurality of tuning elements, wherein for each of the inter-resonator couplings, at least one of the resonators associated with the inter-resonator coupling has a first tuning element placed at a first location on the resonator and a second tuning element placed at a second location on the resonator, and wherein the tuning elements are configured for simultaneous and offset tuning.

These and other aspects, objects, and features of the present invention will become apparent from the following detailed description of the exemplary embodiments, read in conjunction with, and reference to, the accompanying drawings.

BRIEF DESCRIPTION OF THE DRAWINGS

FIG. 6(*b*) is a circuit diagram of a differential coupled-line lumped-element model.

FIG. 7(*b*) is a plot of calculated normalized varactor tuning curves for constant absolute bandwidth and intrinsic off states in accordance with an exemplary embodiment of the invention.

FIG. 8(*b*) is a plot of the tuning curves for a constant-absolute bandwidth of the mixed topology, in accordance with an alternative exemplary embodiment of the invention.

DETAILED DESCRIPTION OF EXEMPLARY EMBODIMENTS

Figure 1:
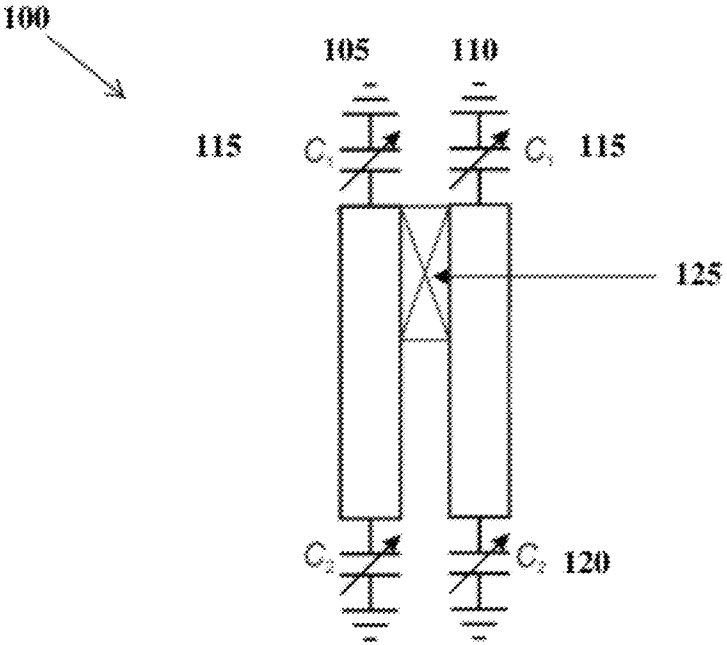
FIG. 1 is a circuit diagram of a filter in accordance with an exemplary embodiment of the invention.

Referring now to the drawings, in which like numerals represent like elements, aspects of the exemplary embodiments will be described in connection with the drawing set.

In general, the inter-resonator couplings of a microwave filter are determined by the corresponding spatial distributions of the electromagnetic fields between each resonator, which are in turn determined by the voltage and current distributions of the individual resonators at resonance. In prior art combline resonators, the electric and magnetic couplings are equal and opposite and thus cancel when the capacitive loading is equal to zero (i.e., the couplings "resonate"). As the capacitive loading is increased, overall net coupling increases with magnetic coupling dominating. The location of the coupling resonance, or resonances, is thus related to the bandwidth for a given tuned center frequency. In prior art tunable filter architectures, the coupling resonances typically remain fixed as the filter is tuned.

In accordance with an exemplary embodiment of the invention, a means of tuning the coupling resonance(s) and thus bandwidth for a given tuned center frequency can be provided. Bandwidth tuning can be achieved with the use of more than one tuning element per resonator. Furthermore, zero bandwidth, i.e., intrinsic switching, can occur when the coupling resonance coincides with the tuned center frequency.

More specifically, a method for designing a bandpass filter with independently tunable bandwidth and center frequencies can be provided by designing a filter with multiple resonators, wherein the resonators can be coupled over a certain coupling region, which can be known as an inter-resonator coupling. In addition to the resonators, there can be multiple tuning elements, such as varactors. For each of the inter-resonator couplings in the filter, at least one of the resonators associated with that inter-resonator coupling can have a first tuning element placed at a first location on the resonator and a second tuning element placed at a second location on the resonator. For example, the first tuning element (e.g., a first varactor) can be placed at one end of the resonator, and the second tuning element (e.g., a second varactor) can be placed at the opposite end of the resonator. Subsequently, when the tuning elements are simultaneously tuned, the center frequency of the filter can be adjusted. Furthermore, when the tuning elements are offset tuned, the bandwidth frequency can be adjusted.

FIG. 1 is a circuit diagram of a filter 100 in accordance with an exemplary embodiment of the invention. More specifically, FIG. 1 represents a pseudo-combline resonator architecture that allows for simultaneous control of center frequency and bandwidth. In FIG. 1, two pseudo-combline transmission line resonators 105 and 110 are shown with two varactors, C1 115 and C2 120, that can be placed at the opposite ends of the resonators 105 and 110. The resonators 105 and 110 can be coupled over a certain area 125, which can determine the baseline location of the coupling resonance. Offset tuning of the varactors, i.e., changing the ratio of C1 115 and C2 120, can effectively vary the ratio of electric to magnetic coupling, and thus the total net coupling and bandwidth.

More specifically, multiple tuning elements can be provided for multiple resonators. Specifically, in FIG. 1, two varactors, C1 115 and C2 120, are provided for two resonators 105 and 110, which can be coupled, which can be called an inter-resonator coupling, over a certain area, region, 125. When the two tuning elements, i.e., varactors C1 115 and C2 120, are simultaneously tuned, the center tuning frequency can be tuned, or adjusted. However, when the ratio of the tuning elements, varactors, of C1/C2 are effectively varied, i.e., offset varactor tuning, the ratio of electric to magnetic coupling can be varied, and thus the total net coupling and bandwidth can be adjusted. In effect, the offset tuning can be variably tuned down to 0 MHz, whereby the filter 100 is effectively switched off. Therefore, the filter 100 represents a resonator structure, which can allow for independent control of center frequency and bandwidth.

Figure 2:
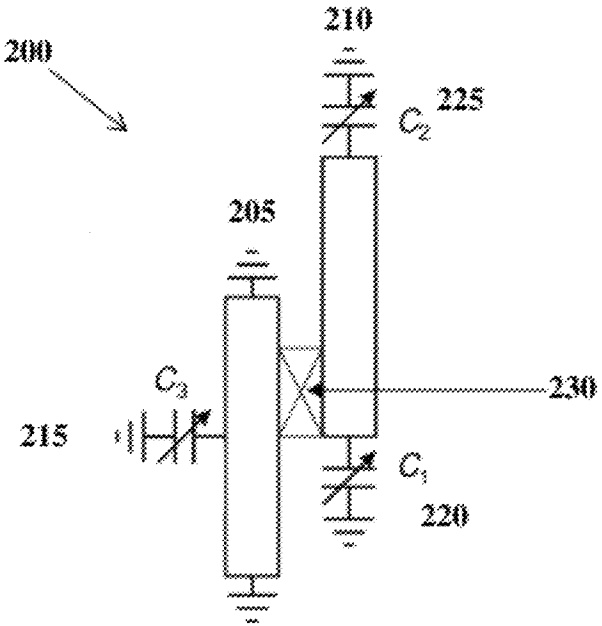
FIG. 2 is a circuit diagram of a filter in accordance with an alternative exemplary embodiment of the invention.

FIG. 2 is a circuit diagram of a filter 200 in accordance with an alternative exemplary embodiment of the invention. Specifically, FIG. 2 represents a mixed-resonator architecture (i.e., a coupled pseudo-combline and grounded pseudo-combline resonators), which can allow for simultaneous control of center frequency and bandwidth. This particular architecture was chosen as it can provide for a symmetric passband response (the coupling between non-adjacent resonators can be minimized) as well as a narrow form factor and a wide stopband.

More specifically, tuning elements, varactors C1 220, C2 225, C3 215, can be provided for resonators 205 and 210 which can be coupled over a certain area, or region, 230. When all three tuning elements, i.e., varactors C1 220, C2 225, C3 215, are simultaneously tuned, the center tuning frequency can be adjusted. However, when the ratio of the tuning elements, i.e., varactors of C1/C2 are effectively varied, i.e., offset varactors tuning, the ratio of electric to magnetic coupling is varied, and thus the total net coupling and bandwidth can be adjusted, or tuned. In effect, offset tuning can variably tune the bandwidth down to 0 MHz, whereby the filter 200 is effectively switched off. Therefore, the filter 200 represents a resonator structure, which can allow for independent control of center frequency and bandwidth while tuning the same tuning elements of the filter.

Figure 3:
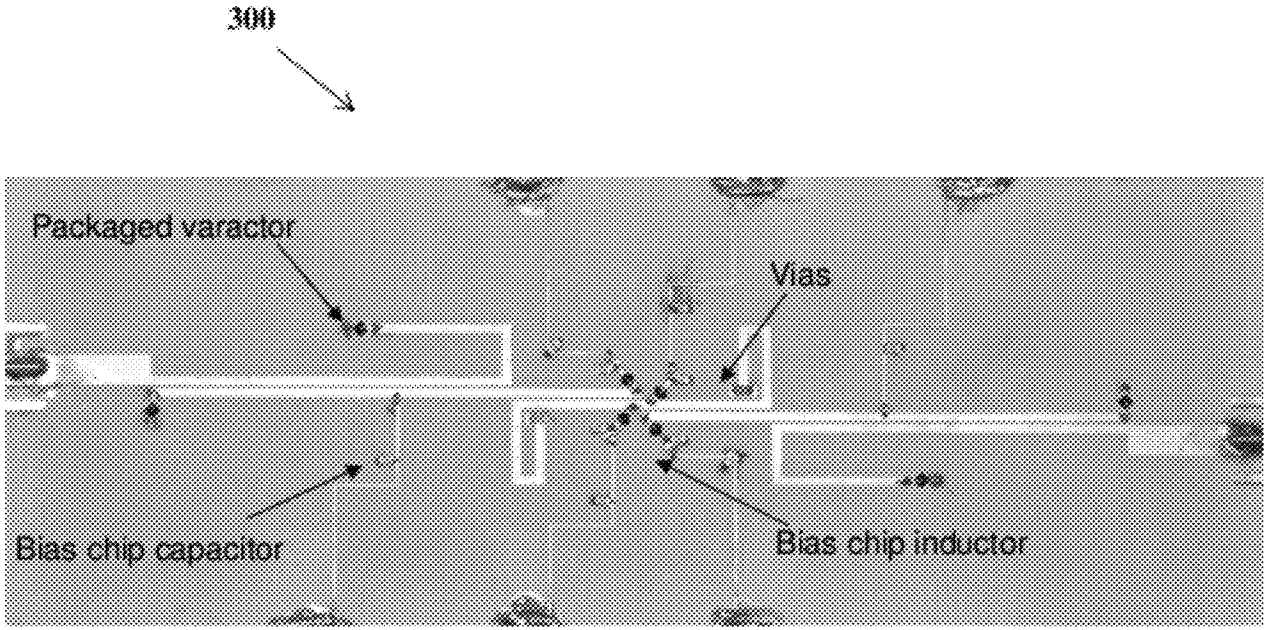
FIG. 3 is a fabricated filter circuit in accordance with an alternative exemplary embodiment of the invention.

FIG. 3 is a fabricated filter 300 in accordance with an alternative exemplary embodiment of the invention. Specifically, the resonator geometry reflected in the circuit diagram of filter 200 in FIG. 2 can be utilized to fabricate filter 300, which is a 3rd-order microstrip prototype. The central resonator can be a pseudo-combline with grounded ends, with two varactors in the center. Outer resonators are pseudo-combline with varactors at both ends. Input and output return loss is tuned with the use of varactors placed at the ends of the input and output transmission lines.

In an exemplary embodiment of the invention, the substrate for the filter 300 can be Rogers RO4003 ($\epsilon_r$=3.38, thickness=60 mils), and the varactors can be Aeroflex Metelics MGV-125-24 (GaAs, hyper-abrupt, $C_j$=0.35-7.3 pF). To maintain a good return loss response (~20 dB) with bandwidth tuning, the input and output couplings are tuned using varactor-loaded open-ended stubs.

Figure 4:
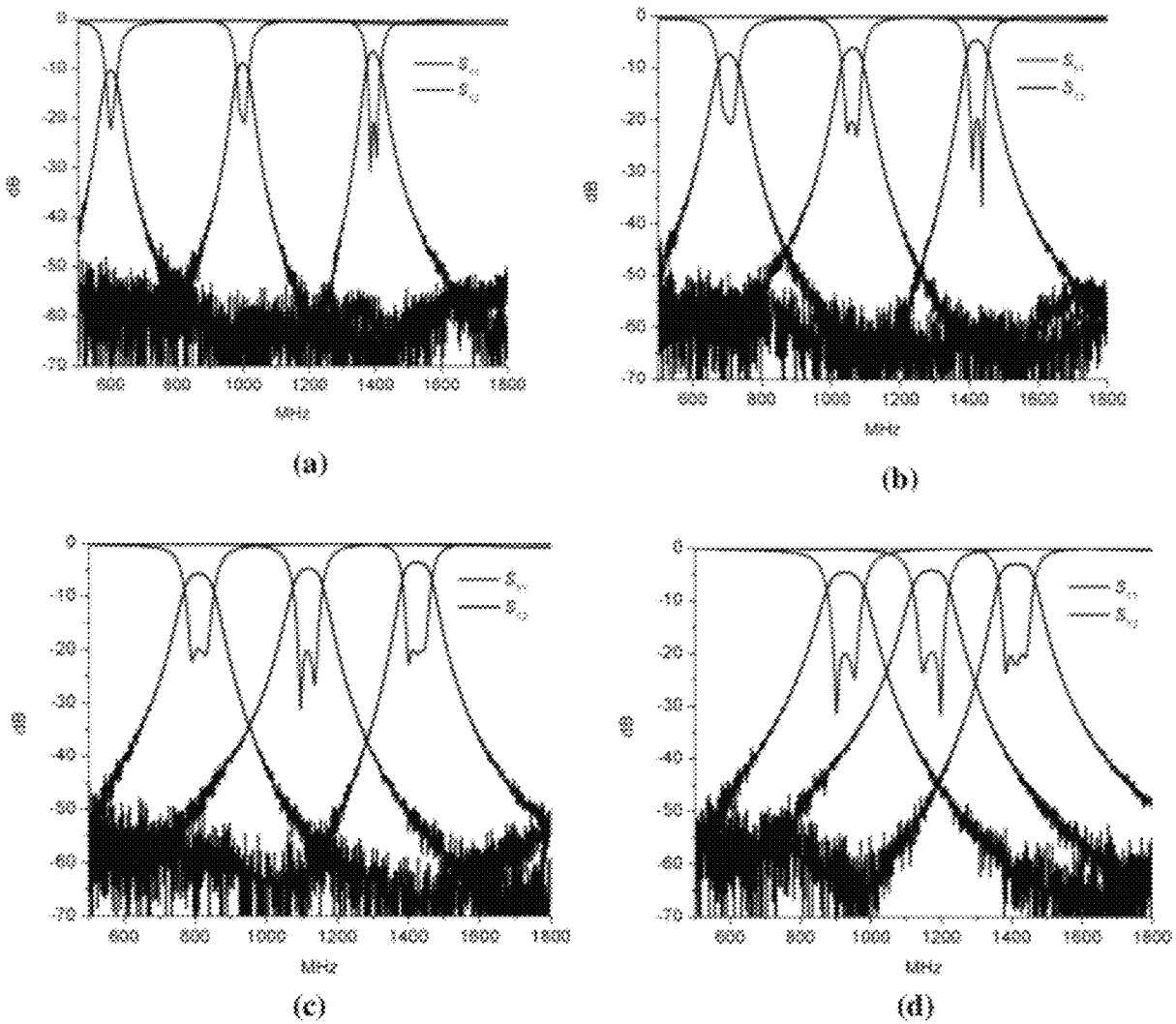
FIG. 4 is a plot of the measured center frequency tuning for four different bandwidths: (a) 40 MHz, (b) 60 MHz, (c) 80 MHz, and (d) 100 MHz in accordance with an exemplary embodiment of the invention.
Figure 5:
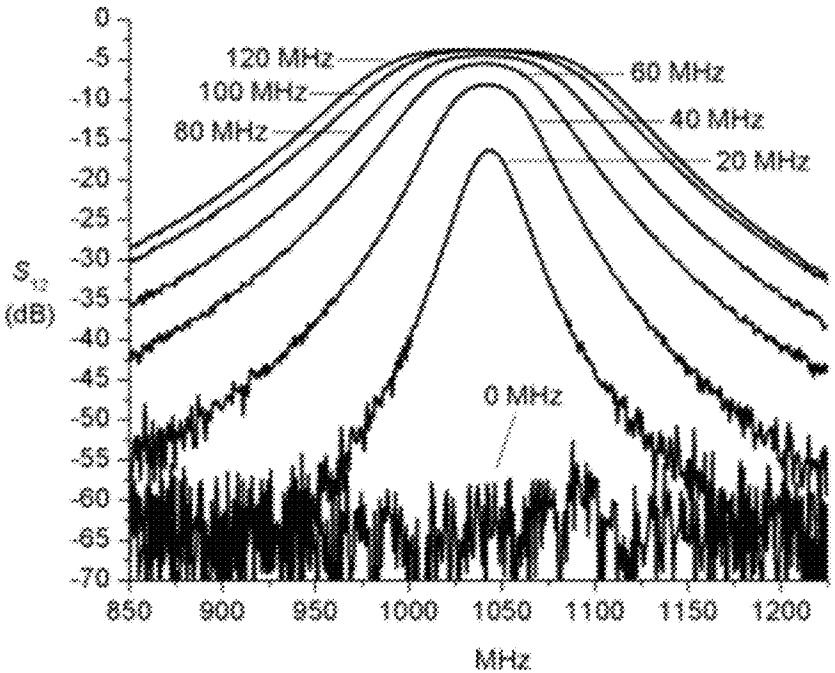
FIG. 5 is a plot of the bandwidth tuning in accordance with an exemplary embodiment of the invention.

FIG. 4 is a plot of the measured center frequency tuning for four different bandwidths: (a) 40 MHz, (b) 60 MHz, (c) 80 MHz, and (d) 100 MHz in accordance with an exemplary embodiment of the invention. Specifically, the plots are measured results of the filter 300. At a bandwidth of 40 MHz, the center frequency tuning range extends well over an octave. FIG. 5 is a plot of the bandwidth frequency tuning in accordance with an exemplary embodiment of the invention. Specifically, the plots are measured results of the filter 300. The bandwidth at the center of the tuning range is tunable from 120 MHz down to 0 MHz, wherein the filter is intrinsically switched off.

In an exemplary embodiment of the invention, and as noted above with respect to FIGS. 1 and 2, the resonators can be coupled over a certain area, which can be called an inter-resonator coupling. A novel aspect of the invention that is presented shows that varactor-tuned transmission-line type resonator structures may be analyzed in an intuitive fashion by assuming a certain distribution of voltage and current, and calculating the coupling coefficient from the energy contained in the resonators and the coupling region. The result leads to a relatively simple expression for the coupling coefficient versus center frequency of general resonator geometries, which can allow for identification of resonator structures with useful tuning properties. In addition, it can be shown that the design and optimization of tunable bandpass filters in a circuit simulator is simplified by the identification of coupling resonances between adjacent resonators, and a simple technique for observing these resonances is described.

At a basic approach, a coupling coefficient between two resonators can be determined by from the coupling bandwidth. For example, in a standard narrowband case:

$$k = \frac{\omega_2^2 - \omega_1^2}{\omega_2^2 + \omega_1^2} \approx \frac{\omega_2 - \omega_1}{\omega_0}$$

$$\omega_0 = \frac{\omega_2 + \omega_1}{2}$$

$$\Delta\omega_{12} = \omega_2 - \omega_1 = \omega_0 k$$

Where k is the coupling coefficient, $\Delta\omega_{12}$ is the coupling bandwidth, $\omega_1$ and $\omega_2$ are the resonant peak frequencies, and $\omega_0$ is the center frequency. The 3-dB bandwidth of a filter is proportional to $\Delta\omega_{12}$, if the shape of the $\Delta\omega_{12}$ vs. $\omega_0$ characteristic is the same for every pair of resonators.

Figure 6:
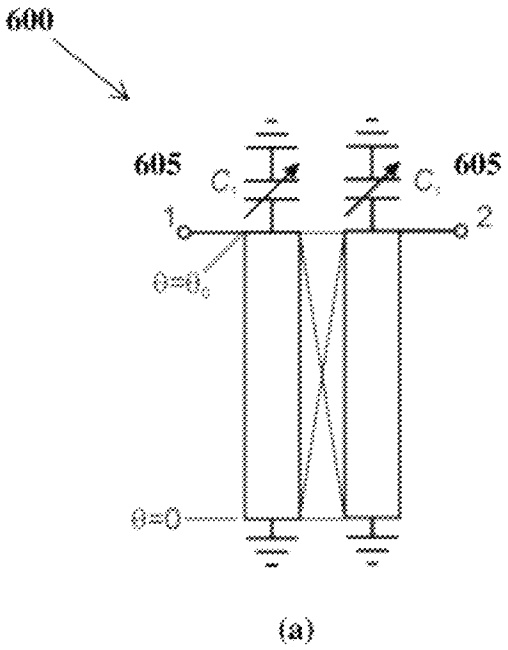
FIG. 6(*a*) is a circuit diagram of a pair of coupled combline resonators.
Figure 6:
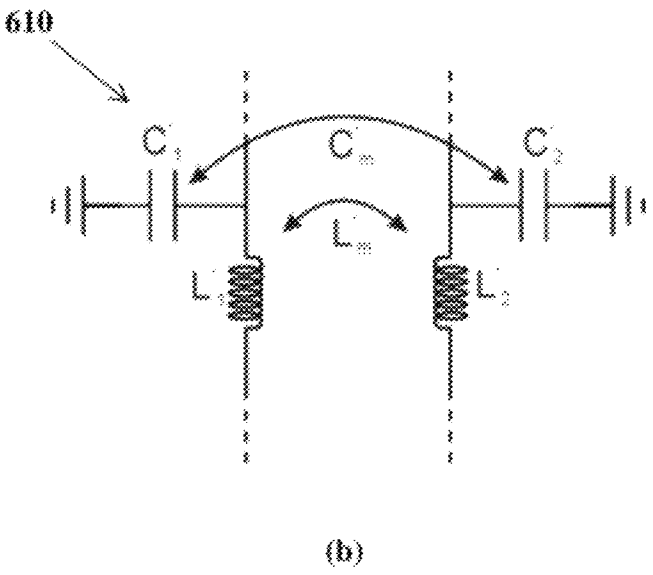

To determine the exemplary embodiments disclosed in FIGS. 1 and 2, general resonator geometries were first analyzed. For example, in a structure 600 with a pair of coupled combline resonators loaded with varactors $C_1$ 605, as shown in FIG. 6(*a*), the structure can be analyzed using the equivalent circuit of shunt and series shorted stubs, known to one of ordinary skill in the art. While this approach works well for the combline, the equivalent circuit quickly becomes very complex when the analysis of more general resonator structures is attempted. If the goal is to extract the bandwidth versus center frequency characteristic for more general resonator geometries (and therefore identify other useful tunable filter architectures), a more convenient and intuitive approach is to calculate the coupling coefficient directly from the differential lumped-element coupled-line equivalent circuit 610, as shown in FIG. 6(*b*). This can be done by assuming a voltage and current distribution consistent with the boundary conditions in each resonator at resonance, and calculating the energy stored in the resonators and the coupling region. In the prior art, this technique has previously been applied to fixed-tuned filters. The capacitive and inductive coupling coefficients $k_C$ and $k_L$ can be given by:

$$k_C = \frac{W_{C_m}}{2\sqrt{W_{C_1} W_{C_2}}}$$

$$k_L = \frac{W_{L_m}}{2\sqrt{W_{L_1} W_{L_2}}}$$

where $W_{Cm}$ and $W_{Lm}$ is the total capacitive and inductive energies stored in the coupling region, and $W_{C1}$, $W_{C2}$ and $W_{L1}$, $W_{L2}$ are the total capacitive and inductive energies stored in each of the two resonators. These variables can be calculated by integrating the capacitive or inductive energy stored in the differential lumped elements. Assuming narrowband conditions, the total coupling coefficient k can be:

$$k = \frac{k_L + k_C}{1 + k_L k_C} \approx k_L + k_C$$

and the coupling bandwidth $\Delta\omega_{12}$ can be calculated by the previously presented equation:

$$\Delta\omega_{12} = \omega_2 - \omega_1 = \omega_0 k$$

Figure 7:
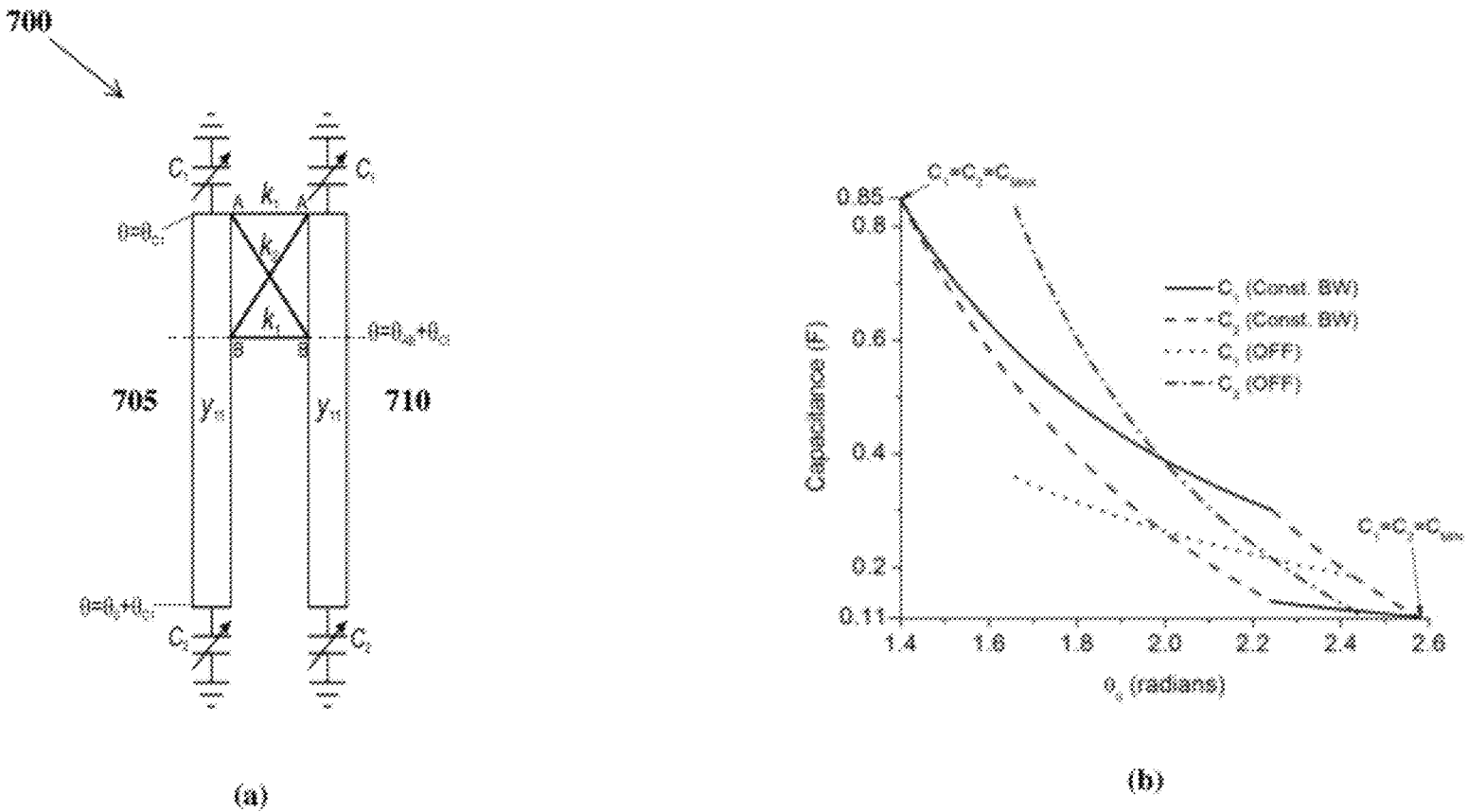
FIG. 7(*a*) is a circuit diagram of a pair of varactor-loaded transmission-line resonators in accordance with an exemplary embodiment of the invention.

Utilizing these known equations above, identifying other useful tunable filter architectures can be possible. For example, FIG. 7(*a*) is a circuit diagram of a filter 700 of a pair of varactor-loaded transmission-line resonators, which is identical to the exemplary embodiment of the invention disclosed in FIG. 1 and associated text. In FIG. 7(*a*), the pair of varactor-loaded transmission-line resonators 705 and 710 can be coupled to each other over an electrical length $\theta_{AB}$ from one end. FIG. 7(*a*), as well as FIG. 8(*a*) discussed below, will be utilized to show a simplified analysis of the intrinsically switched resonator topologies in accordance with an exemplary embodiment of the invention. From this analysis, varactor tuning curves for the constant absolute bandwidth and intrinsic off states can be derived.

The standard definition of the coupling coefficient between two resonators is:

$$K = \frac{k_{12}}{\sqrt{b_1 b_2}}$$

where $k_{12}$ is the admittance of the inverter representing the coupling, and $b_1$ and $b_2$ are the susceptance slope parameters of the two resonators 705 and 710. Assuming weak coupling, the voltages and currents in the resonators 705 and 710 at resonance are unaffected by the presence of the admittance inverters $k_1$ and $k_2$, and so the total coupling coefficient can be written:

$$K = \frac{k_1}{b_A} + \frac{k_1}{b_B} + 2\frac{k_2}{\sqrt{b_A b_B}}\operatorname{sgn}(V_A V_B)$$

where $b_A$ and $b_B$ are the susceptance slope parameters looking into the resonator at nodes A and B, respectively. The sgn $(V_A V_B)$ term can be included, to take into account the effect of phase shift across the resonator; therefore, the equation can be simplified to:

$$K = \frac{y_{12}\cos(\theta_{AB} + 2\theta_{C1})\sin\theta_{AB}}{4\omega_o W_m}$$

The coupling coefficient K is zero (the intrinsic off state) when:

$$\theta_{C1} = \frac{\pi}{4} - \frac{\theta_{AB}}{2},$$

and the coupling bandwidth is:

$$BW = \omega_o K$$

FIG. 7(*b*) is a plot of calculated normalized varactor tuning curves for constant absolute bandwidth and intrinsic off states. More specifically, it shows varactor tuning curves for a constant absolute bandwidth state and the intrinsic off state, derived using the above equations and where $C_1$ and $C_2$ are given by:

$$C_1 = \frac{y_{11}\tan\theta_{C1}}{\omega_o}$$

$$C_2 = \frac{y_{11}\tan\theta_{C2}}{\omega_o}$$

It should be noted that $C_1$ and $C_2$ exchange values near the high end of the tuning range. The pseudo-combline topology of FIG. 7(*a*) exhibits an "optimum" tuning curve, where $C_1$ and $C_2$ are equal at both the minimum and maximum tuned center frequencies, and thus the full range of all tuning elements can used for center frequency tuning.

Figure 8:
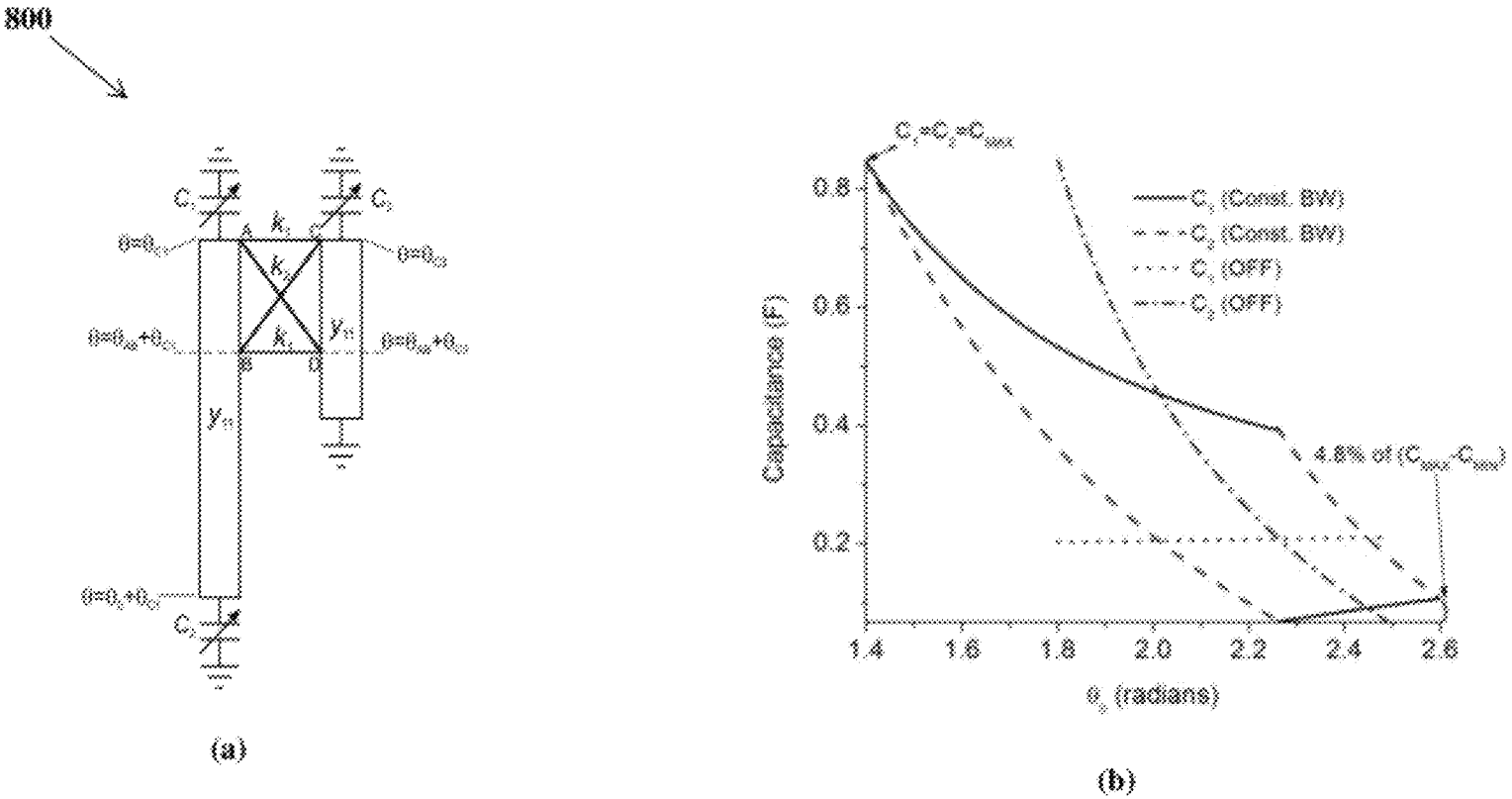
FIG. 8(*a*) is an intrinsically switchable coupled-resonator topology, comprised of an offset-tuned pseudo-combline resonator and a non-offset-tuned combline resonator, in accordance with an alternative exemplary embodiment of the invention.

FIG. 8(*a*) is an intrinsically-switchable coupled-resonator topology 800, comprised of an offset-tuned pseudo-combline resonator and a non-offset-tuned combline resonator, in accordance with an alternative exemplary embodiment of the invention. The magnetic energy stored in the non-offset-tuned combline resonator is:

$$W_{mc} = \frac{L'}{4}\int_0^{\frac{l_0}{2}} \cos^2 Bl\,dl = \frac{y_{11}}{16\omega_0}(\theta_0 + \sin\theta_0)$$

The stored magnetic energy $W_m$ can be calculated by integrating the energy stored in the inductance per unit length ($L^{T_1}$) over the length of the resonator:

$$W_m = \frac{L'}{4}\int_{l_{C1}}^{l_0+l_{C1}} l^2\,dl = \frac{L' y_{11}^2}{4}\int_{l_{C2}}^{l_0+l_{C2}} \sin^2\beta l\,dl = \frac{y_{11}}{16\omega_0}(2\theta_0 + \sin 2\theta_{C1} - \sin 2(\theta_0 + \theta_{C1}))$$

where the current I is given by $I = y_{11}\sin\theta$, $\beta$ is the phase constant, and using:

$$L' y_{11}^2 = C' = y_{11}\frac{\beta}{\omega_o}$$

-continued $$l_0 = \frac{\theta_0}{\beta}$$

$$l_{C1} = \frac{\theta_{C1}}{\beta}$$

The coupling coefficient is then:

$$K = k_1\left(\frac{\mathrm{sgn}(V_A V_C)}{\sqrt{b_A b_C}} + \frac{\mathrm{sgn}(V_B V_D)}{\sqrt{b_B b_D}}\right) + \left(\frac{\mathrm{sgn}(V_A V_D)}{\sqrt{b_A b_D}} + \frac{\mathrm{sgn}(V_B V_C)}{\sqrt{b_B b_C}}\right) = \frac{y_{12}\cos(\theta_{AB} + \theta_{C1} + \theta_{C3})\sin\theta_{AB}}{8\omega_0\sqrt[C]{W_{mc} W_m}}$$

where $$\theta_{C2} = \frac{\pi - \theta_0}{2}.$$

The coupling coefficient of the mixed coupled-resonator topology of FIG. 8(*a*) is dependent on the cosine of $\theta_{C1}$, while the coupling coefficient of the symmetric pseudo-combline topology of FIG. 7(*a*) is dependent on the cosine of $2\theta_{C1}$. Therefore, the latter is more sensitive to offset tuning, which is to be expected as both resonators are offset tuned in the symmetric pseudo-combline topology. FIG. 8(*b*) is a plot of the tuning curves for a constant-absolute bandwidth of the mixed topology. The tuning curves of FIG. 8(*b*) are somewhat less than optimal, sacrificing 4.8% of the total varactor tuning range. Although non-ideal in this regard, this topology allows for a very practical realization, in accordance with an exemplary embodiment of the invention. Also, note that $C_1$ for the intrinsic off state is nearly constant for the full tuning range of $C_2$, which simplifies varactor bias control.

In summary, the exemplary filter resonator architecture described herein can provide many advantages over prior art bandpass filters. The primary advantage is that the presented designs can allow for the realization of tunable microwave bandpass filters with new tuning capabilities and improved performance. Furthermore, the bandwidth tuning can be accomplished with the same tuning elements used to tune the center frequency.

Another significant advantage of the filter resonator architecture is the reduction of additional hardware required in the filters. For example, inter-resonator tuning elements are not required which can allow for significant size reduction. Additionally, as the approach utilizes the controlled cancellation of couplings, narrow bandwidths can be achieved using closely-spaced resonators allowing for size reduction. Furthermore, half the number of resonators can be required compared to dual-band approaches to achieve the same selectivity, which can allow for significant size reduction. In addition, resonant inter-resonator tuning elements are not required which can allow for a stopband free of spurious passbands.

Finally, unlike other bandwidth-tuning approaches, in an exemplary embodiment of the invention, the bandwidth frequency can be tuned down to zero, i.e., intrinsically-switched. More specifically, intrinsic switching results from when the offset tuning controls voltage and current distributions so that the electric and magnetic couplings cancel. Another advantage of intrinsic switching is that it can allow for higher isolation compared to external semiconductor switches, e.g., >60 dB for a 3rd-order microstrip filter.

It should be understood that the foregoing relates only to illustrative embodiments of the present invention, and that numerous changes may be made therein without departing from the scope and spirit of the invention as defined by the following claims.

The invention claimed is:

1. A method for independently tuning bandwidth and center frequencies in a bandpass filter, comprising the steps of:

configuring the filter with a plurality of resonators comprising at least a first resonator and a second resonator, wherein the first and second resonators are coupled over an electrical length known as an inter-resonator coupling, and a plurality of tuning elements comprising at least a first tuning element and a second tuning element, wherein at least one of the first and second resonators has the first tuning element placed at a first location on the resonator and the second tuning element placed at a second location on the resonator;

simultaneously tuning the first and second tuning elements to adjust the center frequency; and wherein the bandwidth frequency can be tuned to zero solely by changing a ratio of capacitance between the first and second tuning elements of the bandpass filter to adjust the bandwidth frequency.

2. The method of claim 1, wherein the step of changing the ratio of capacitance between the first and second tuning elements further adjusts a total net coupling.

3. The method of claim 1, wherein the inter-resonator coupling is an electrical and magnetic coupling.

4. A bandpass filter, comprising:

a plurality of resonators comprising at least a first resonator and a second resonator, wherein the first and second resonators are coupled over an electrical length known as an inter-resonator coupling; and a plurality of tuning elements comprising at least a first tuning element and a second tuning element, wherein at least one of the first and second resonators has the first tuning element placed at a first location on the resonator and the second tuning element placed at a second location on the resonator, and wherein the first and second tuning elements are configured for simultaneous and offset tuning, and wherein a bandwidth frequency of the bandpass filter can be tuned to zero solely by changing a ratio of capacitance between the first tuning element and the second tuning element of the bandpass filter.

5. The filter of claim 4, wherein the simultaneous tuning of the first tuning element and the second tuning element adjusts the center frequency of the filter.

6. The filter of claim 4, wherein changing the ratio of capacitance between the first tuning element and the second tuning element adjusts the bandwidth frequency of the filter.

7. The filter of claim 4, wherein the first and second tuning elements are varactors.

8. The filter of claim 4, wherein the inter-resonator coupling is an electrical and magnetic coupling.

* * * * *